United States Patent [19]

Schroeder

[11] 4,098,193

[45] Jul. 4, 1978

[54] WEAR AND CORROSION REDUCING ADDITIVE FOR GUN PROPELLANTS

[75] Inventor: Michael A. Schroeder, Bel Air, Md.

[73] Assignee: The United States of America as represented by the Secretary of the Army, Washington, D.C.

[21] Appl. No.: 721,617

[22] Filed: Sep. 8, 1976

[51] Int. Cl.[2] ..... F42B 5/12; F42B 1/00; C06B 45/00

[52] U.S. Cl. ..... 102/92; 102/39; 149/2

[58] Field of Search ..... 102/92, 103, 38 R, 39, 102/DIG. 1; 149/2, 35, 42; 252/50; 260/308 D

[56] References Cited

U.S. PATENT DOCUMENTS

| | | | |
|---|---|---|---|
| 2,244,705 | 6/1941 | Hutchinson | 102/92 |
| 2,346,124 | 4/1944 | Dew | 102/92 |
| 2,407,037 | 9/1946 | Sowa | 102/92 |
| 3,046,168 | 7/1962 | Burkardt | 149/42 |
| 3,148,620 | 9/1964 | Jacobson | 102/38 |
| 3,204,558 | 9/1965 | Jacobson | 102/38 |
| 3,209,689 | 10/1965 | McLennan | 102/38 |
| 3,332,353 | 7/1967 | Burkardt | 102/70 R |
| 3,403,626 | 10/1968 | Jacobson | 102/38 |
| 3,707,411 | 12/1972 | Gawlick | 102/DIG. 1 |
| 3,877,374 | 4/1975 | Cook | 102/38 |

*Primary Examiner*—Samuel W. Engle
*Assistant Examiner*—Donald P. Walsh
*Attorney, Agent, or Firm*—Nathan Edelberg; Harold H. Card, Jr.; A. Victor Erkkila

[57] ABSTRACT

The interior surfaces of gun barrels are protected from wear and corrosion by applying a laminar additive of an organic compound to a gun propellant in such a manner that the heat generated by firing of the gun causes the compound to decompose thereby evolving gaseous products which buffer said interior surfaces from the corrosive and wearing effects of the combustion products of the propellant.

2 Claims, 9 Drawing Figures

WEAR AND CORROSION REDUCING ADDITIVE FOR GUN PROPELLANTS

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention relates to a method of decreasing the corrosion and wear of gun barrels. More particularly, the invention relates to a laminar additive which decomposes by the heat of firing to gaseous products which reduce wear and corrosion in gun barrels.

2. Description of the Prior Art

The effective life of gun barrels is dependent upon several factors of which two are basic or controlling factors. The first factor is the fatigue or deterioration of the mechanical properties of the metal of the gun barrel which is caused by thermal and stress cycling from repeated firing of the gun. The second factor, which is of importance, is the corrosion of the barrel which occurs upon repeated firing of the weapon which manifests itself in the form of bore enlargement or damage of the internal surface of the bore. In view of these detrimental problems there is active interest in the development of means for reducing the corrosion and fatigue problems in gun barrels caused by repeating firing of weapons.

In one prior art technique for reducing corrosion in gun barrels, the interior surfaces of the bore are coated or lined with a corrosion resistant material. In another approach a wear-reducing additive is incorporated within the propellants which forcibly expel a projectile from a gun barrel. The wear-reducing additive is normally structured as a sheath of material formed of an organic substance such as a polyurethane foam or paraffin frequently mixed with an inorganic material such as titanium dioxide. The sheath of material generally known as a laminar additive, is wrapped about the front end of the propellant charge behind the projectile (see FIG. 1). Although the exact reasons of how the sheath material functions as a corrosion reducing agent are not clearly understood, it is believed that the corrosion-reducing action arises from or is a function of the cellular structure (in the case of the polyurethane foam), or that combustion or vaporization of the sheath upon firing of a weapon forms a comparatively cool and/or unreactive layer of gas in close proximity to the barrel walls, or that a solid insulating layer is deposited on the surface of the bore.

Of the types of materials which are commonly used as additive sheaths are polyurethane foams which are extensively used in the United Kingdom, Canada and the United States, and a mixture of paraffin wax and titanium dioxide commonly known as "Swedish additive." It is also known that the substitution of talc for titanium dioxide gives rise to improved results. However, a problem with the conventional sheath materials is that after firing of a weapon, residues of the inorganic material remain on the interior surfaces of the barrel since the inorganic material is not volatile. This has possible unpredictable effects on the ballistic characteristics of the weapon because of the accumulated residue.

Another prior art procedure as described in U.S. Pat. No. 3,877,374 shows a method of applying a protective coating of a substance to the external surfaces of caseless ammunition. In the disclosed method the external surfaces of caseless propellant charges are coated with microcapsules of a vaporizable material such as wax, silicone oil, or the like encapsulated in a confining skin of gelatin, polyvinyl alcohol, epoxy, or the like. The coating of microcapsules performs the dual function of protecting the caseless propellant from the detrimental influence of heat because of the poor heat transfer characteristics of the encapsulated material, and of vaporizing by the heat generated when the propellent is fired which distributes the encapsulated material over the surface of the gun bore thereby protecting the surfaces of the bore from the corrosive effects of the combustion gases. This technique, however, is disadvantageous because of difficulties in manufacturing the microcapsules. The microcapsules also may not withstand rough handling, which could give rise to seepage of the encapsulated material into the propellant thereby having unpredictable effects on the ballistic characteristics of the weapon.

A need, therefore, continues to exist for a method of protecting the bores of gun barrels with a wear and corrosion resistant material in a manner which overcomes the deficiencies of the prior art methods.

SUMMARY OF THE INVENTION

Accordingly, one object of the present invention is to provide a method for protecting the bores of gun barrels from the corrosive and wearing effects of the combustion products of propellant charges.

Briefly, this object and other objects of the present invention as hereinafter will become more readily apparent can be attained in a method for protecting the interior surfaces of gun barrels from wear and corrosion by applying a laminar additive of an organic compound to a gun propellant in such a manner that the heat generated by firing of the gun causes the compound to decompose thereby evolving gaseous products which buffer the internal surfaces from the corrosive and wearing effects of the combustion products of the propellant.

BRIEF DESCRIPTION OF THE DRAWINGS

A more complete appreciation of the invention and many of the attendant advantages thereof will be readily obtained as the same becomes better understood by reference to the following detailed description when considered in connection with the accompaying drawings, wherein.

FIGS. *2a–22g* represents various configurations of laminar sheaths within projectile casings.

DETAILED DESCRIPTION OF THE PREFERRED EMBODIMENTS

Figure 1:
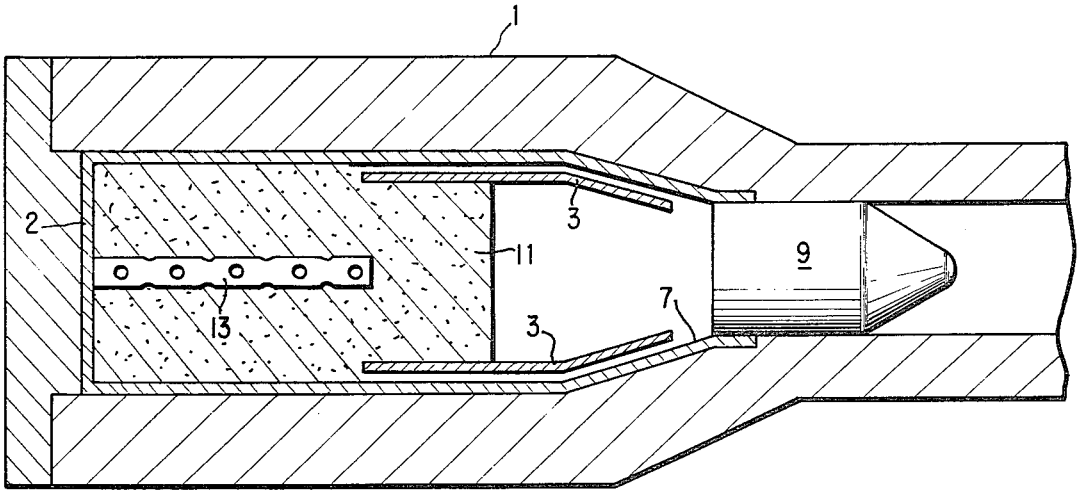
FIG. 1 is a cross-sectional view of a cartridge in the chamber of a gun (firing mechanism not shown) showing the disposition of laminar sheaths of the wear and corrosion resisting material of the present invention.

The essential aspect of the present invention is the application of certain types of organic compounds in close enough proximity to the propellant charge behind a projectile in a gun barrel which decompose from the heat of firing of the propellant thereby releasing large amounts of gas. The released gas buffers the bore of the gun barrel from the corrosive and wearing effects of the combustion gases by providing a less corrosive atmosphere next to the inner surfaces of the gun barrel. In the broadest aspects of the invention, any compound which thermally decomposes to release a gas can be used as the decomposable compound. A number of organic compounds are known which thermally decompose at relatively low temperatures, i.e. about 25° to 300° C, preferably about 150°–200° C, releasing large amounts of gas. Suitable thermally decomposable compounds include nitrogen rich compounds such as tetrazoles, e.g. various 2, 5-disubstituted and 1, 5-disubstituted tetrazoles of the formula:

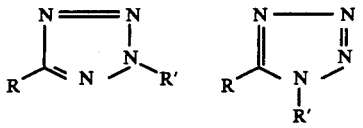

wherein R and R; and aryl, alkyl or other substituents and polymeric materials containing tetrazole residues such as poly(2-methyl-5-vinyltetrazole) (PMVT), poly(1-vinyltetrazole), poly(1-methyl-5-vinyltetrazole) and poly(1-vinyl-5-aminotetrazole), and various lower alkyl substituted polyvinyltetrazoles thereof; all types of organic azides such as alkyl and aryl azides including phenyl azides, tolylazide, xylyl azide, polyvinylazide and the like.

The organic compounds decompose from the heat generated from the firing of the weapon resulting in the discharge of a cooler, less corrosive gas envelope about the inner surface of the bore. The decomposition of the organic compound is represented by the following equation showing the decomposition of a 2, 5-disubstituted tetrazole to products.

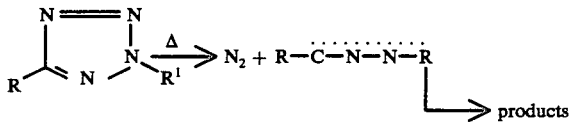

In still other embodiments of the invention nonpolymeric and polymeric tetrazole ring containing compounds or other gas producing compounds could be mixed with other additives such as wax, polyurethane or polyethylene and the mixture can be used as a wear and corrosion reducing material. Alternatively, other well-known components such as talc and titanium dioxide which improve the wear-reducing abilities of wax when it is used as an additive, could also be combined with the gas producing compounds of the present invention. These other materials can be combined with the decomposable compound of the invention in any amounts that will allow the material to be formed into sheaths.

In the present invention, the decomposable organic compound is used as a laminar sheath. In a preferred embodiment the sheaths are made by dissolving the particular organic compound desired in a solvent. The solvent can be warmed if necessary to complete dissolution of the compound. Any solvent which is capable of dissolving the particular organic compound used can be employed. Consequently, a wide variety of solvents can be used which include methylene chloride, chloroform and acetonitrile. Normally, the solution is then concentrated by any satisfactory technique which is generally an evaporation technique of some sort including simple exposure to air, vacuum drying and the like. The concentrated solution can then be poured over a strip of cloth in several layers. Suitable cloth materials include cotton, cotton-synthetic material blends and the like. Each layer poured is allowed to dry before the next layer is poured. After complete drying, the strip can then be cut into smaller size strips sufficient for use in a cartridge. It can be appreciated that the method described only represents a preferred embodiment of preparing the laminar sheath. Any other convenient method by which a cloth strip can be impregnated with the decomposable organic compound can be employed. The thickness of the laminar sheaths produced is not critical. Any thickness of material which produces the desired wear reducing effects is satisfactory.

FIG. 1 shows an embodiment of the invention in which the wear and corrosion resisting material of the present invention is disposed in the form of additive sheaths 3 about the inner periphery of casing 7 immediately behind projectile 9 of catridge 2. The cartridge contains propellant 11 in the base surrounding ignitor element 13. The cartridge is shown within breech 1 of a gun in position for firing. When the gun is fired, the heat generated by the ignited propellant causes decomposition of the material in the sheath thereby causing, in turn, the evolution of the gaseous decomposition products of the additive material.

FIGS. *2a–2g* represents various possible configurations of the laminar sheath within a projectile casing which can be employed in the method of the present invention.

Figure 3:
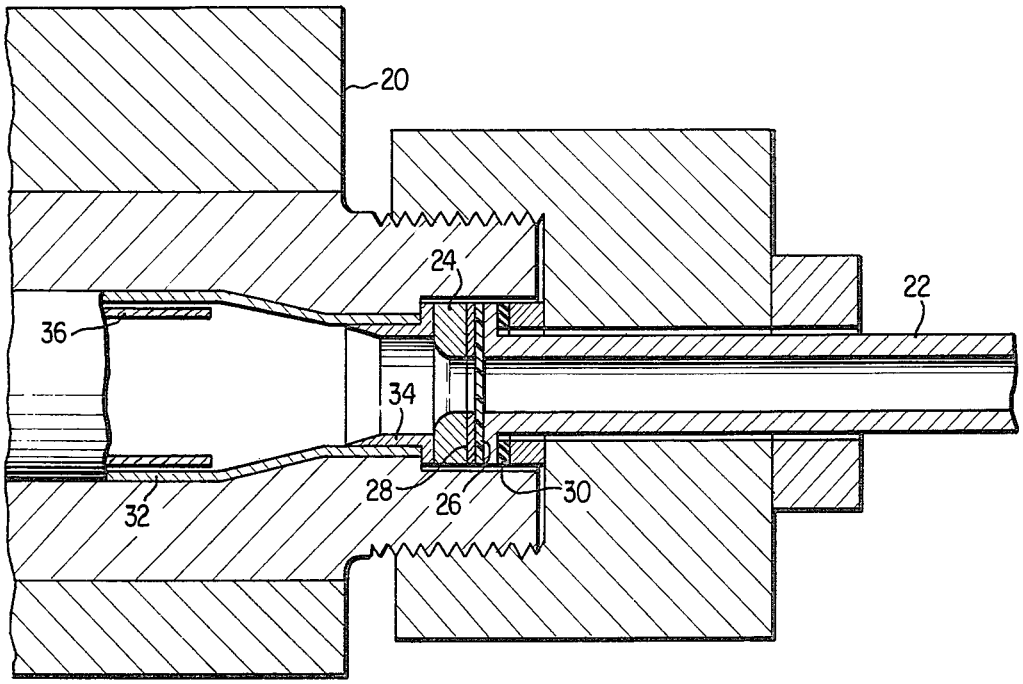
FIG. 3 is a cross-sectional view of the breech end of a modified 37 mm gun employed to test the effectiveness of the wear and corrosion resisting material of the present invention.
Figure 2A:
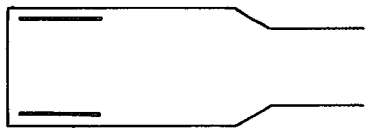
Figure 2B:
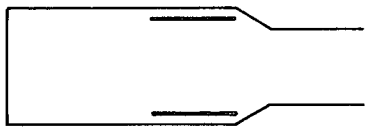
Figure 2C:
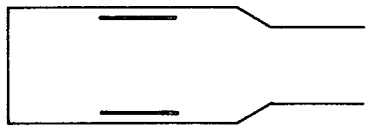
Figure 2D:
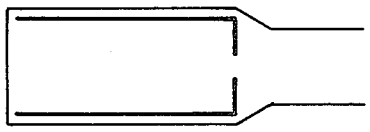
Figure 2E:
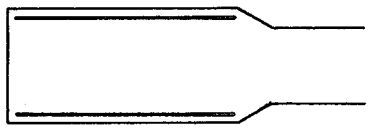
Figure 2F:
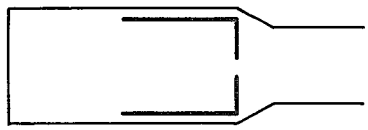
Figure 2G:
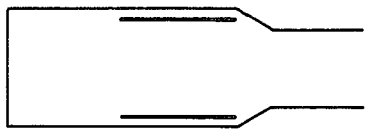

The effectiveness of the additive material was tested in a modified 37 mm gun as shown in FIG. 3. The figure shows a cross-sectional view of the breech end of the gun 20 equipped with barrel 22. The gun shown is essentially the same as a normal 37 mm gun except that it was modified by the placement of nozzle 24 in a position corresponding aproximately to the place where the rifling in the bore of the gun normally beings. The gun was also modified by the placement of a blowout disc 26 immediately in front of the nozzle to provide obturation. The structure of the gun was completed by positioning spacer ring 28 between the nozzle and blowout disc and by placing rubber washer 30 in the position shown. The casing 32 of a cartridge lacking a projectile is shown immediately behind retaining ring 34. Additive sheaths or strips 36 of the wear and corrosion resisting material of the present invention are disposed about the inner periphery of the casing. It was believed that the laminar sheaths of the present invention could be adequately tested in the modified gun as shown because of the physical and general hydrodynamic similarity of the modified gun and the interior of a normal gun as shown in FIG. 1.

The modified 37 mm gun was used in a series of tests as follows. An additive strip of a tetrazole containing polymer, i.e. PMVT or other additive was disposed about the inner periphery of a casing as shown in the configuration of FIG. *2g* extending back about one-half of the length of the widest part of the shell casing.

The additive strips containing a decomposable organic compound of the present invention were prepared as follows. A 28 g amount of PMVT (poly 2-methyl-5-vinyltetrazole) was dissolved in 350 ml of a solvent with warming and stirring. The solvent used for the preparation of the strips used in shots 41A and 41B (Table 3) was methylene chloride, while acetonitrile was used for all of the other shots in Table 3. Each solution was concentrated by evaporation in a fan-driven, vented fume hood, and then poured over a cloth one layer at a time. The cloth strip was spread on the bottom of a dish. Between applications of the concentrated solution, the cloth was allowed to dry. After completion of the addition of the concentrated solution, the cloth was allowed to dry overnight and then removed from the bottom of the dish. Each strip was cut into 7.6 × 14.0 cm strips, which were allowed to stand for several days, numbered and weighed.

Additive strips of Gulfwax used in the tests were prepared by melting the wax in a beaker, and then repeatedly dipping cloth strips into the melted wax. The impregnated strips were then cut into smaller strips 7.6 × 14.0 cm, numbered and weighed.

The Swedish additive, polyurethane foam and uncoated cloth were used as received .

Each casing employed in the test was loaded with 85 g of M2 propellant lot no. 35683 which has the composition shown in Table 1 below. The propellant was ignited with an M38B2 primer, i.e., 54 grains of black powder. The modified gun was fired electrically by remote control. A wad of paper "Kimwipe" tissue was used as wadding for each shot. For each shot taken precautions were taken to assure that the nozzle, spacer ring and retainer ring were oriented the same way relative to each other and to the chamber.

TABLE 1

| Composition | | | | Stability and Physical Tests | |
|---|---|---|---|---|---|
| Constituent | | Formula | Inspt | | Inspt |
| Nitrocellulose | 76.20 | 76.18 | 76.62 | 120° C heat test S.P. | 95 |
| Nitroglycerin | 19.50 | 19.49 | 18.88 | Fumes | NONE |
| Dinitrotoluene | 1.00 | 1.00 | 1.19 | Form of grain | Cyld. |
| Barium Nitrate | 1.50 | 1.50 | 1.39 | No. of perforations | 1 |
| Potassium Nitrate | 0.80 | 0.80 | 0.98 | | |
| Diphenylamine | 0.75 | 0.75 | 0.64 | | |
| Graphite | 0.28 | 0.28 | 0.30 | | |
| Moisture | | | 0.55 | | |
| Ash | | | 0.05 | | |
| Total Volatiles | | | 1.31 | | |
| Graphite glaze (added) | | 0.03 | | | |

After each firing, the nozle was removed from the gun and washed alternately several times with detergent-water and acetone. The cleaned nozzle was then placed in an acetone ultrasonic cleaning bath for about two minutes. Thereafter, the nozzle was placed on a hot plate to drive off all traces of acetone and then allowed to cool and weighed. The amount of weight loss of the nozzle during firing was used as an index of corrosion. The results are shown in Table 2 below which indicate the percent reduction of corrosion based on 10 grams of additive for all of the additive studied.

TABLE 2

Summary of Results — Nozzle Corrosion

| Additive | Number of Shots | Percent Reduction of Corrosion per 10 grams of Additive |
|---|---|---|
| None | 7 | 0 |
| Cloth | 7 | 12.8 |
| Gulfwax | 7 | 29.6 |
| XM-1[a] | 7 | 47.9 |
| PMVT[b] | 6 | 53.3 |
| Polyurethane | 2 | 64.2 |

[a]XM-1 Swedish Additive
[b]Poly(2-methyl-5-vinyltetrazole)

The results above show that all of the additives with the exception of the uncoated cloth afforded protection by significantly reducing corrosion. The relative effectiveness of the contrasted additives, i.e. XM-1 Swedish additive > wax and PMVT > wax, are respectively significant at the 95 and 99 percent confidence levels according to the *t* test. The *t* test is a standard test which is used in testing the significance of trends in experimental data. A thorough discussion of the test is set forth by H. A. Laitinen, "Chemical Analysis", McGraw-Hill, New York, 1960, pp. 546–552. The PMVT additive of the present invention is somewhat superior to the Swedish additive and the conventional polyurethane additive is a somewhat more efficient corrosion reducer than the XM-1 additive.

Table 3 below shows the ordering of corrosion reducing abilities, wherein a high number associated with a certain additive signifies that the particular additive was a more efficient corrosion reducer than as additive having a lower number. Thus, for example, with shots 34A–38A all fired on the same day, using the same nozzle the most efficient additive was the Swedish additive followed by wax and cloth in that order. The overall results indicate that PMVT of the present invention compares favorably with the currently used Swedish and polyurethane foam additives. In the table the column headings are numbers each of which designates a series of shots all fired on the same day using the same nozzle. For example, shots 39–43A were all fired the same day using nozzle A.

TABLE 3

Relative Corrosion-Reducing Efficiencies of Laminar Additives for Shots Fired On Same Day

| Series | 34A–38A | 39–43A | 39–43B | 44–8A | 44–8B | 49–54A | 49–54B |
|---|---|---|---|---|---|---|---|
| None | 1 | 2 | 1 | 2 | 1 | 1 | 1 |
| Cloth | 2 | 1 | 2 | 1 | 3 | 2 | 2 |
| Gulfwax | 3 | 3 | 3 | 3 | 2 | 5 | 3 |
| XM-1[a] | 4 | 4 | 5 | 4 | 4 | 3 | 5 |
| PMVT[b] | | 5 | 4 | 5 | 5 | 4 | 4 |
| Polyurethane | | | | | | 6 | 6 |

[a]XM-1 Swedish Additive
[b]Poly(2-methyl-5-vinyltetrazole)

I wish it to be understood that I do not desired to be limited to the exact details of construction shown and described, for obvious modifications can be made by a person skilled in the art.

What is claimed as new and intended to be secured by Letters Patent is:

1. A method of protecting the interior surfaces of gun barrels from wear and corrosion, which comprises: applying an unfoamed laminar sheath comprising poly(2-methyl-5-vinyltetrazole) to a gun propellant in such a manner that the heat generated by firing of the gun causes the compound to decompose thereby evolving gaseous products which buffer said interior surfaces from the corrosive and wearing effects of the combustion products of the propellant.

2. Ammunition comprising a cartridge case, a projectile positioned at an open end of said cartridge case, an explosive charge within said cartridge case for generating propellant gases to propel said projectile through a bore of a gun barrel in which the ammunition is used, and an unfoamed laminar sheath comprising poly(2-methyl-5-vinyltetrazole) disposed around said charge for generating gases, which buffer the inner surfaces of the gun barrel from the corrosive and wearing effects of the combustion products of the propellant by providing a less corrosive atmosphere next to the inner surfaces of the gun barrel.

* * * * *